US006264509B1

(12) United States Patent
Kwang et al.

(10) Patent No.: US 6,264,509 B1
(45) Date of Patent: Jul. 24, 2001

(54) HIGH CYCLE TERMINAL WITH PROTECTED FAILSAFE CONTACT

(75) Inventors: David Kwang, Southfield; Mark S. Grant, Whitelake, both of MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 09/758,495

(22) Filed: Jan. 10, 2001

(51) Int. Cl.[7] ..... H01R 11/52
(52) U.S. Cl. ..... 439/852
(58) Field of Search ..... 439/850, 851, 439/852, 853, 854, 862

(56) References Cited

U.S. PATENT DOCUMENTS

| | | | | |
|---|---|---|---|---|
| 4,607,907 | | 8/1986 | Bogursky . | |
| 4,696,530 | | 9/1987 | Vandame . | |
| 4,699,444 | | 10/1987 | Isohata . | |
| 4,795,379 | | 1/1989 | Sasaki et al. . | |
| 5,083,936 | | 1/1992 | Yang . | |
| 5,350,321 | | 9/1994 | Takenouchi . | |
| 5,540,603 | | 7/1996 | Fujiwara . | |
| 5,601,458 | * | 2/1997 | Ohsumi et al. | 439/852 |
| 5,722,925 | | 3/1998 | Kameyama et al. . | |
| 5,733,155 | | 3/1998 | Sagawa . | |
| 5,941,740 | * | 8/1999 | Neuer et al. | 439/852 |
| 6,062,918 | | 5/2000 | Myer et al. . | |
| 6,079,988 | | 6/2000 | Hashiguchi et al. . | |
| 6,152,788 | * | 11/2000 | Hata et al. | 439/852 |
| 6,206,738 | * | 3/2001 | Sugie | 439/852 |

FOREIGN PATENT DOCUMENTS

| | | |
|---|---|---|
| 03205555 | 2/1993 | (JP) . |
| 04004236 | 7/1993 | (JP) . |

* cited by examiner

*Primary Examiner*—Brian Sircus
*Assistant Examiner*—Son V. Nguyen
(74) *Attorney, Agent, or Firm*—Young and Basile, P.C.

(57) ABSTRACT

A spring contact for a female wire harness terminal, the spring contact having a sacrificial ramp which a mating terminal wipes on insertion. The sacrificial ramp includes an aperture below which a failsafe contact connected to a spring portion of the ramp rests until the mating terminal nears full insertion, at which point the spring portion forces the failsafe contact upwardly through the aperture into electrical engagement with the mated terminal. The ramp bears the brunt of the sacrificial wiping; the failsafe contact remains out of wiping contact with the mating terminal until a point at or near the end of terminal insertion, thereby preserving the mating conductive portions of the failsafe leg and the mating terminal from sacrificial wear. This protected, end-of-insertion failsafe connection allows the female spring contact to maintain good electrical connection with the mating terminal over many cycles in high cycle applications.

14 Claims, 3 Drawing Sheets

FIG-1
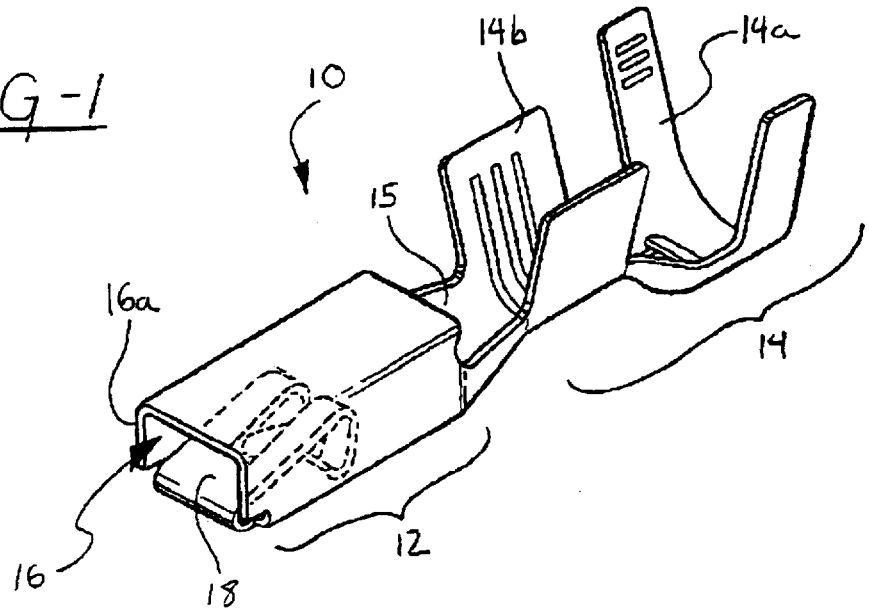
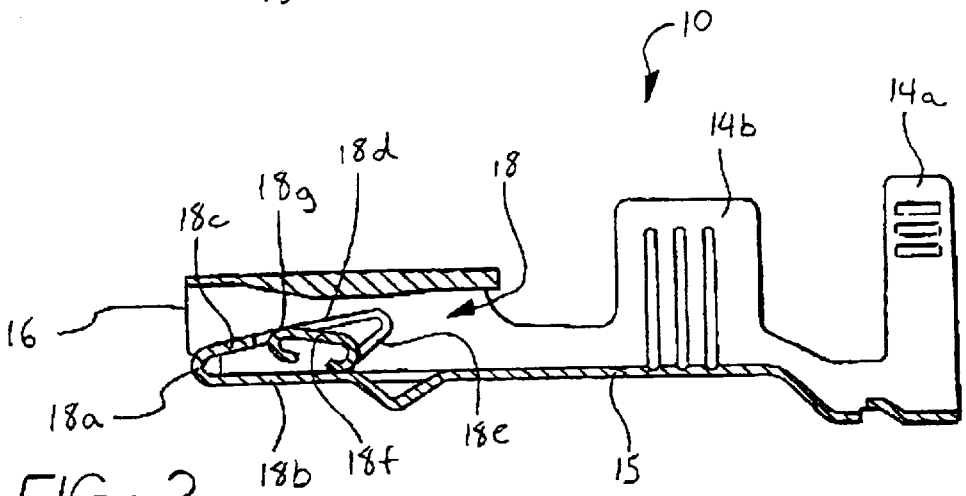
FIG-2
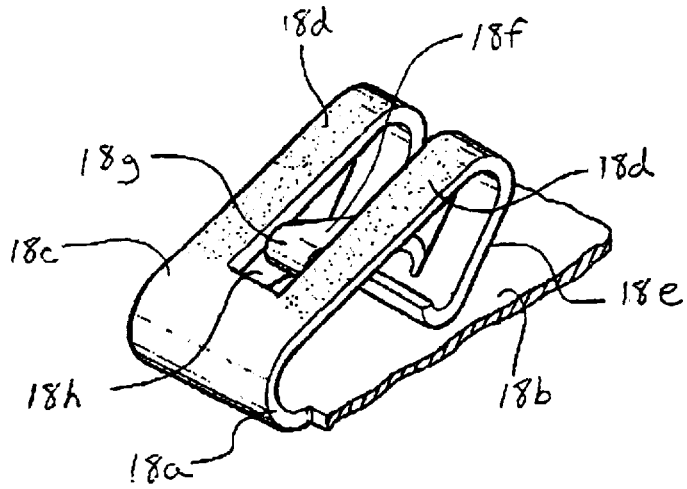
FIG-3

HIGH CYCLE TERMINAL WITH PROTECTED FAILSAFE CONTACT

FIELD OF THE INVENTION

The present invention is in the field of electrical wire harness terminals of the type used in automotive electrical systems, and more particularly to such terminals with sacrificial terminal coatings adapted for high cycle use.

BACKGROUND OF THE INVENTION

Wire harness and other connector terminals of the type used in vehicle electrical systems are often applied to "high cycle" connections, i.e. connections repeatedly made, broken, and re-made according to the operation, testing, or servicing of components which the terminals connect to power. Examples of vehicle components using high cycle connections include convertible roofs, removable stereos, and removable seats, to name but a few.

A small number of prior high cycle terminals have a resilient spring contact which offers both a sacrificial wiping surface and a spring force for an inserted male terminal to establish clean, intermittence-free contact. The sacrificial wiping surface is often coated or plated with a highly-conductive material such as tin or gold to enhance the electrical connection.

The quality of the electrical connection suffers if too much of the sacrificial surface or coating is wiped off after numerous cycles, or if the spring portion loses its force after being over-deflected too far or too many times.

SUMMARY OF THE INVENTION

The present invention is a high cycle female electrical terminal with a ramped spring type contact adapted to receive a male terminal blade in an enclosed terminal chamber. The contact portion of the female terminal includes an upwardly ramped or angled sacrificial wiping section and a downwardly angled spring leg which supports the ramp section and which allows the ramp section to yield under spring tension when a male terminal blade is inserted into the female terminal. The ramp section includes a slot or aperture below which a "failsafe" contact remains protected underneath the sacrificial ramp surface. The failsafe contact, however, is connected to the spring leg in cantilevered fashion such that downward compression of the ramp section by a male terminal forces the failsafe contact up through the slot into contact with the male terminal. This failsafe connection is preferably made at or near the point of full insertion of the male terminal, such that the failsafe contact and the portion of the male terminal which it engages are not subjected to significant sacrificial wear.

In an alternate embodiment of the invention, the sacrificial ramp section is multi-angled, i.e. it includes an initial wiping section or shield which first engages the male terminal, and a rearwardly-spaced sacrificial ramp section having a height greater than the initial wiping section and connected to the spring leg to raise the failsafe contact as the male terminal is fully seated. The initial wiping section of the ramp and the final sacrificial section may be connected by an angled portion such that the male terminal's contact with the initial wiping section lowers the failsafe contact slightly, so that the failsafe is even more securely ensured against wear during the initial insertion. Upon the male terminal's subsequent contact with the final sacrificial section, the spring leg is compressed downwardly and forwardly to raise the failsafe contact into engagement with the male terminal.

The failsafe contact may be provided with its own stop leg extending downwardly so as to limit the downward motion of the failsafe contact and prevent over-deflection of the terminal as the male blade is inserted. This feature is particularly useful in the multi-angled ramp embodiment in which the failsafe contact moves in a two stage down-up motion.

Although the term "blade" is used herein to describe the male terminal inserted into contact with the inventive female terminal, it will be understood that the invention is not limited to use with a flat blade, but may accommodate other shapes adapted to engage the female spring terminal, which shapes may be uniform or may vary at the tip of the male terminal or at other locations along its length to affect how quickly the various portions of the female spring contact react to its insertion, and thereby affect the point at which the failsafe contact is raised into contact with the male terminal.

These and other features and advantages of the present invention will become apparent upon further reading of the specification, in light of the accompanying drawings.

BRIEF DESCRIPTION OF THE DRAWINGS

FIG. 1 is a perspective view of a female wire harness connector terminal incorporating a female spring contact according to the invention;

FIG. 2 is a side section view of the terminal of FIG. 1, better illustrating the structure of the female spring contact in an enclosed, chamber-like end portion of the terminal.

FIG. 3 is a perspective view of the female spring contact of FIG. 2, illustrated apart from the chamber end of the terminal for clarity.

DETAILED DESCRIPTION OF THE ILLUSTRATED EMBODIMENTS

Figure 4:
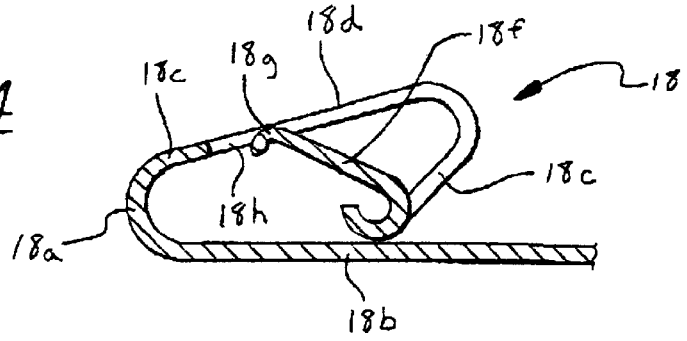
FIG. 4 is a side section view of the spring contact of FIG. 3 in an at-rest condition.

Referring first to FIGS. 1 and 2, a female wire harness terminal of the type commonly used to make automotive wire harness connections is illustrated generally at 10. Wire harness terminal 10 is formed from conductive metal such as copper or tin-plated copper, often stamped from a flat blank in a foldable pattern which can be formed into the final shape illustrated in FIG. 1. Terminal 10 can generally be divided into a terminal connection end 12 and a wire connection end 14. Wire connection end 14 is electrically and mechanically secured to insulated and exposed portions of an electrical wire of known type (not shown) by crimped tabs 14*a,* 14*b* in known manner. Wire connection end 14 is both electrically and mechanically connected to terminal connection end 12 by a stem portion 15 which leads to a terminal chamber 16 formed by a folded-over metal tab 16*a*. Chamber 16 contains a female spring contact 18 adapted to receive a male terminal blade and to establish and maintain an electrical connection with the terminal blade in chamber 16.

Referring to FIG. 2, female spring contact 18 in the illustrated embodiment is formed from a folded strip of metal extending integrally from terminal 10. It will be understood by those skilled in the art that although this integrally formed, stamped, and folded spring contact configuration is preferred, spring contact 18 can also be formed separately and inserted into chamber 16 and secured therein in known manner.

Illustrated female spring contact 18 includes a bight or bend 18*a* integrally connecting an upwardly-angled ramp portion 18*c* to its "base" 18*b*. Ramp 18*c* has a sacrificial wiping region 18*d,* preferably coated with a conductivity-enhancing metal such as gold or tin. Ramp 18*c* terminates in a downwardly-angled spring leg 18*e,* in the illustrated embodiment simply another bend or fold in the sheet or strip of metal from which the contact is formed. Spring leg 18*e* is angled downwardly and "forwardly" (toward bend 18*a* at the insertion end of the female terminal chamber) until it contacts base 18*b* somewhere below the sacrificially coated wiping section 18*d* on the ramp. The end of spring leg 18*e* is free to slide on base 18*b,* and at the same time is flexible or resilient such that it may be deflected toward ramp 18*c* by downward pressure on the ramp, thereby allowing ramp 18*c* to be flattened toward base 18*b*.

Spring leg 18*e* is in turn connected to a failsafe contact leg 18*f,* which in the illustrated embodiment preferably consists of a further folded or bent extension of the metal of spring leg 18*e*. Failsafe contact leg 18*f* is angled upwardly and forwardly toward a forward portion of ramp 18*c,* and in the at-rest terminal condition illustrated in FIG. 2 lies slightly below the surface of ramp 18*c,* in particular below the sacrificially coated section 18*d*.

Referring to FIG. 3, female spring contact 18 is shown in greater detail. It can be seen, for instance, that ramp 18*c* is split down the middle with a slot or aperture 18*h* dividing the sacrificially coated portion into two sacrificial wiping portions or arms 18*d*. Failsafe contact leg 18*f* is cut and bent from a middle portion of spring leg portion 18*e* in alignment with aperture 18*h,* and in the at-rest terminal position shown in FIGS. 2 and 3 its tip 18*g* extends part way into aperture 18*h* below the sacrificially coated surfaces 18*d* on the ramp.

Figure 5:
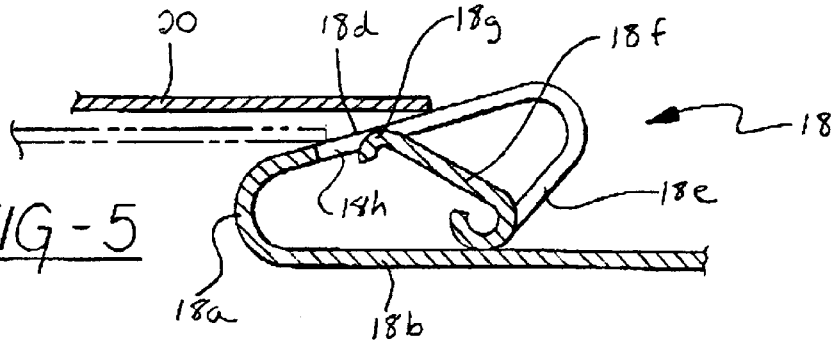
FIG. 5 is a side elevational view of the spring contact according to FIGS. 2–4, showing the initial insertion of a male terminal blade against the female spring contact.
Figure 5A:
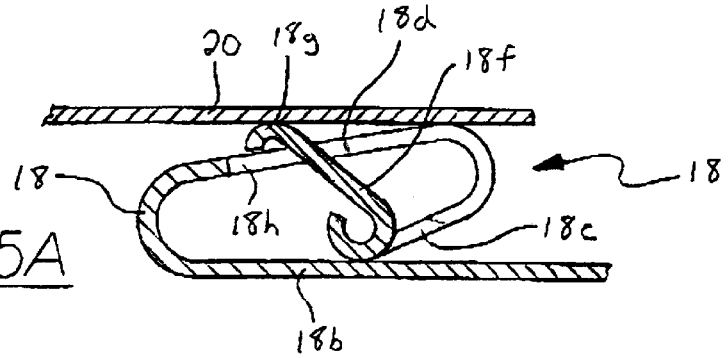
FIG. 5A illustrates the male terminal blade fully inserted to cause maximum deflection of the female spring contact in its final, fully mated condition.
Figure 6:
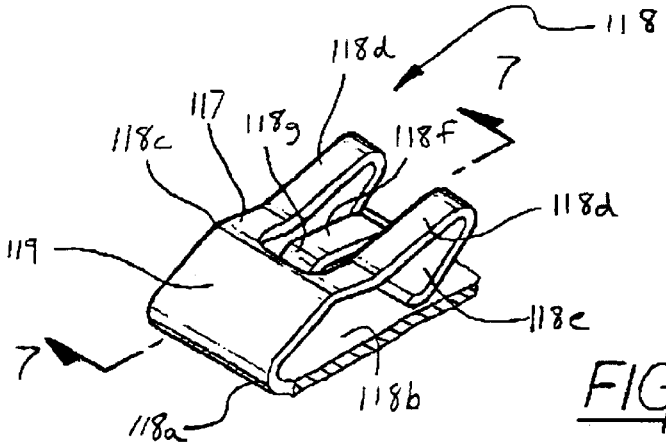
FIG. 6 is a perspective view of an alternate female spring contact structured according to the invention, interchangeable with the female spring contact of FIGS. 1–5A.
Figure 7:
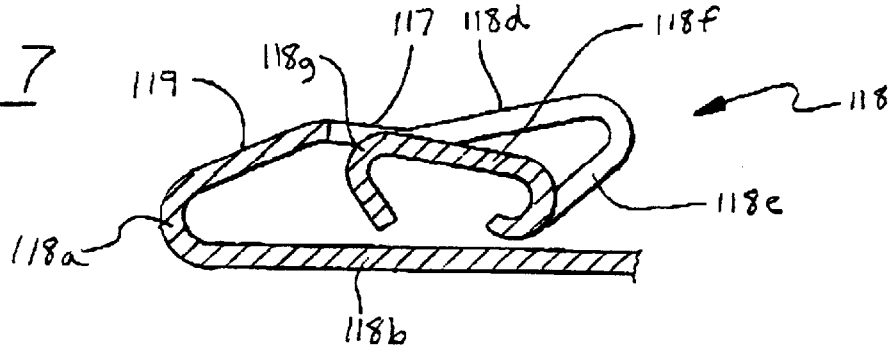
FIG. 7 is a side section view of the alternate female spring contact of FIG. 6.

Referring now to FIGS. 4, 5, and 5A, the ramp, spring leg, and failsafe leg structure of contact 18 can be viewed as three connected cantilevers acting in concert as a male terminal blade is inserted into chamber 16 (see FIGS. 1 and 2) to secure the male terminal blade in the chamber under spring tension and to ensure positive electrical contact even after hundreds or thousands of cycles. Ramp 18*c* can be viewed as the first cantilever leg, flexing about bend 18*a* to yield downwardly as a male terminal blade is inserted in the chamber. Spring leg 18*e* is the second cantilever which, as the ramp 18*c* is forced downwardly by the male terminal blade, slides forward toward bend 18*a* on base 18*b* and is flexed toward ramp 18*c* to increase the spring tension exerted against the male terminal blade. Spring leg 18*e* also prevents over-deflection of ramp 18*c* and the resulting loss of spring tension and good contact with the male terminal blade. Finally, failsafe leg 18*f* is the third cantilever which responds to the motion of leg 18*e* by rotating upwardly into resilient, spring-tensioned contact with the male terminal blade as the male terminal blade reaches the point of full insertion in chamber 16 against ramp 18*c*.

FIGS. 5 and 5A illustrate the action of female spring contact 18 in sequence as a male terminal blade schematically illustrated at 20 is initially inserted (FIG. 5) and then fully inserted (FIG. 5A) in chamber 16 against spring contact 18. As the leading tip of male terminal blade 20 first contacts ramp 18*c* (shown in phantom), it does so at the lowermost or leading edge of the sacrificially coated portion 18*d* which provides a sacrificial "wiping" surface from which oxide and debris is removed by the male terminal blade so that a suitable electrical contact can be made. This cleaning action occurs as the tip of the male blade moves upwardly along surfaces 18*d.* This wiping action primarily cleans the sacrificial surface 18*d* of the spring contact, rather than the male terminal blade, which is more easily cleaned prior to insertion if visual inspection reveals oxide or other matter, since it is more accessible than the chamber-housed female contact 18. This also preserves any plating on the surface of the male terminal blade, such that the primary "sacrifice" is made by the female spring contact, and specifically by portions 18*d.* In other words, the portions 18*d* are sacrificed to gain contact force. The gradual loss of sacrificial material on the female spring contact and the preservation of plating on the male terminal blade are offset and complemented by the operation of failsafe contact 18*f* described below.

As the male terminal blade 20 is inserted further into the female terminal chamber, the spring-like ramp 18*c* is deflected downwardly against its own spring force established by radiused bend 18*a* and is further resisted by the force of spring leg 18*e*. As ramp 18*c* is forced progressively downwardly by the male terminal blade, leg 18*e* is forced forwardly in a sliding motion along base 18*b,* and also upwardly (in a relative sense) toward the underside of ramp 18*c*. Spring leg 18*e* accordingly increases the spring force of ramp 18*c* as terminal insertion progresses, thereby maintaining a good electrical contact with the male terminal blade.

Upon initial insertion of male terminal blade 20, the upper end or contact tip 18*g* of failsafe contact leg 18*f* remains below the sacrificial ramp surface 18*d,* out of contact with terminal 20 through most of its sliding range of motion against the ramp. As the tip of terminal 20 nears or passes the end of the sacrificially coated ramp portion, however, the compression of spring leg 18*e* forces failsafe leg 18*f* upwardly such that tip 18*g* protrudes through aperture 18*h* and engages the underside of the male terminal blade. The angle of ramp 18*c,* the angle of leg 18*e,* the spring force inherent in the material of spring contact 18, and the shape and insertion depth of male terminal blade 20 are all designed to result in the engagement of failsafe contact 18*f* and terminal 20 at or near the end of the male terminal insertion process, thereby preserving the conductivity-enhancing coating or plating preferably formed on the end of failsafe leg 18*f,* and further preserving the region on the underside of the male terminal blade with which the failsafe makes this final contact.

Accordingly, however many times a male terminal is inserted, removed, inserted, removed, etc., from chamber 16, and however much wear of the sacrificial ramp surface 18*d* occurs, the failsafe will provide a highly conductive, strongly-biased, relatively wear-free connection with the fully inserted male terminal blade.

It will also be appreciated that the structure of spring leg 18*e* and its engagement with base 18*b* (directly) and with the underside of the male terminal blade (indirectly via failsafe leg 18*f*) prevents over-deflection of contact 18 and the resulting loss of spring force, even after many cycles.

Referring next to FIGS. 6 through 8B, an alternate embodiment of spring contact 18 is generally illustrated at 118. Spring contact 118 has a multi-angled, multi-part, sacrificially coated wiping surface divided into high-wiping and high-force sections. Specifically, ramp section 118*c* is divided into a sacrificial contact section 118*d* and a wiping/deflector section 119 located forwardly of section 118*d* to bear the brunt of the initial contact and wiping travel of the male terminal blade. In the illustrated embodiment, wiping section 119 is angled more steeply relative to the incoming axis of the male terminal blade than is sacrificial section 118*d,* these two angled portions being connected by a lesser-angled portion 117 which in the illustrated embodiment is preferably horizontal or even downwardly-angled for a purpose hereinafter described.

Failsafe contact leg 118*f* operates in a manner similar to leg 18*f* in the embodiment of FIGS. 1–5, with the exception of an initial downward movement caused by the inserted terminal's initial contact with wiping section 119. As wiping section 119 is initially depressed or compressed by the insertion of a male terminal blade, the angles of sections 117, 118*d,* and 118*e* cause spring leg 118*e* to slide rearwardly and slightly away from ramp 118, drawing the free end of failsafe contact leg 118*f* downwardly and rearwardly. This downward motion is limited by the free end or tip 118*g* of the failsafe leg, which is positioned to abut base 18 to limit overdeflection.

Figure 8:
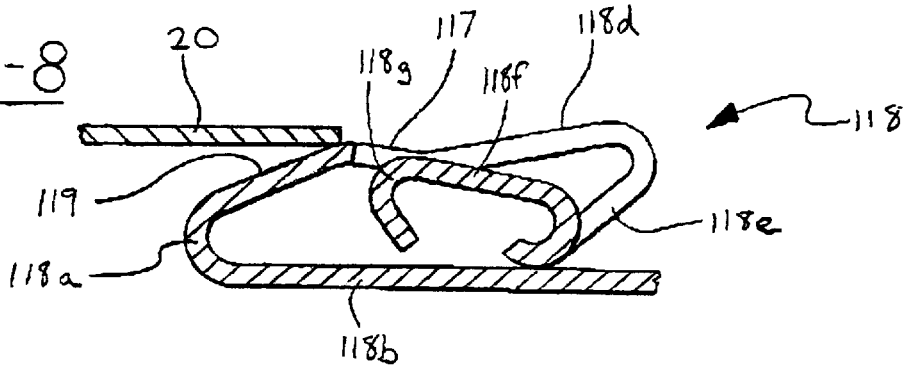
FIG. 8 illustrates the alternate spring contact of FIG. 6 being initially engaged by a male terminal blade.
Figure 8A:
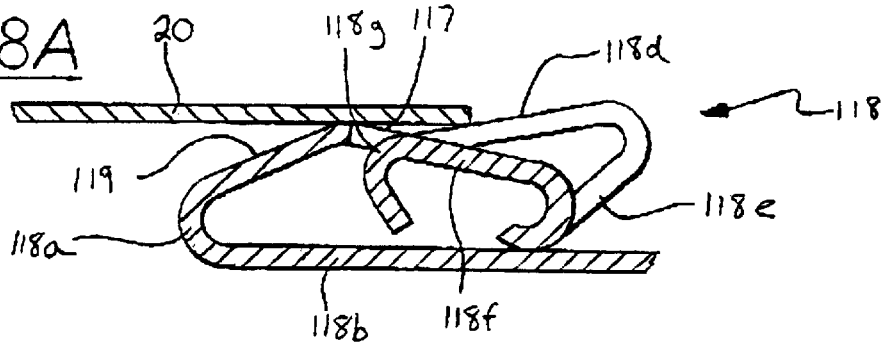
FIG. 8A illustrates the male terminal of FIG. 8 in an intermediate stage of contact with the female spring contact of FIG. 6.
Figure 8B:
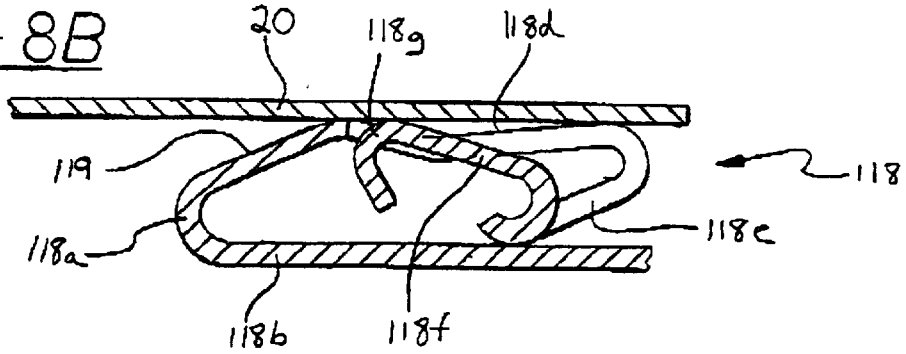
FIG. 8B illustrates the final stage of male terminal insertion against the female spring contact of FIG. 6.

Further insertion of the male terminal past wiping section 119 over section 117 and above failsafe 118*f* (FIG. 8A) results in contact with and compression of sacrificial section 118*d,* which then reverses the motion of spring leg 118*e* and failsafe leg 118*f* to drive them forwardly and upwardly against the underside of the male terminal blade.

Wiping section 119 clears oxide and debris from the male terminal blade. The "peak" or junction of section 119 with section 117 provides a surface for scraping or wiping the flat underside of the male terminal, unlike the ramp portion 18*c* of FIGS. 1–5 which is engaged by the tip of the male terminal for the purpose of clearing the ramp portion. The more steeply angled placement of wiping section 119 also provides a positive deflection of the male terminal blade up and away from failsafe arm 118*f* until the male terminal blade engages sacrificial section 118*d.*

By the time the male terminal blade reaches the sacrificial section 118*d* toward the uppermost and rearmost portion of the female spring contact, normal force of the spring contact has been maximized. With the conductivity enhanced coating of section 118*d* becoming degraded after many cycles, the additional contact established between failsafe leg 118*f* and male terminal 20 further increases the reliability of the connection.

From the foregoing descriptions of the illustrated embodiments, it will be understood by those skilled in the art that many minor modifications to those embodiments can be made and still lie within the scope of the invention. For example, the overall shape and size of the spring contact, the various angles and radii of the bends and surfaces, the thickness and the spring strength of the metal used, and other such considerations which must be customized to each particular terminal application will be readily apparent to those skilled in the art.

Accordingly, we claim:

1. In a wire harness terminal having a female terminal chamber, a spring contact comprising:

a conductive contact base adapted to be electrically connected to a conductive pathway;

a sacrificial ramp portion connected to a forward end of the contact base adjacent a terminal insertion opening in the terminal chamber and extending upwardly and rearwardly at a first angle;

a spring leg connected to a rearward portion of the sacrificial ramp, the spring leg extending downwardly and forwardly at a second angle to a point adjacent the contact base;

a failsafe leg connected to the spring leg and extending upwardly and forwardly at a third angle to a point adjacent but below the surface of the sacrificial ramp when the spring contact is in an at-rest condition; and an aperture in the sacrificial ramp aligned with an upper end of the failsafe leg, wherein compression of the sacrificial ramp by a mating terminal when the mating terminal is in engagement with the sacrificial ramp rearwardly of the upper end of the failsafe leg causes the upper end of the failsafe leg to be moved upwardly through the aperture into electrical contact with the mating terminal.

2. The spring contact of claim 1, wherein a portion of the sacrificial ramp is surfaced with a conductivity-enhancing material.

3. The spring contact of claim 1, wherein the upper end of the failsafe leg is surfaced with a conductivity-enhancing material.

4. The spring contact of claim 1, wherein the lower end of the spring leg is slidably positioned on the contact base in the at-rest condition.

5. The spring contact of claim 1, wherein the spring leg is resiliently connected to the sacrificial ramp, and the failsafe leg is resiliently connected to the spring leg.

6. The spring contact of claim 5, wherein the sacrificial ramp is resiliently connected to the contact base.

7. The spring contact of claim 6, wherein the spring contact is formed from a single piece of conductive metal, the sacrificial ramp being formed by a bend in a forward end of the contact base, the spring leg being formed by a bend in the rearward end of the sacrificial ramp, and the failsafe leg being formed by a bend in the lower end of the spring leg.

8. The spring contact of claim 1, wherein the sacrificial ramp lies in a single plane.

9. The spring contact of claim 1, wherein the sacrificial ramp is multi-planar.

10. The spring contact of claim 9, wherein the sacrificial ramp comprises a forward portion adjacent the forward end of the terminal chamber and a rearward portion spaced from the forward portion, the forward portion being set at a first angle, and the rearward portion being set at a second different angle.

11. The spring contact of claim 10, wherein the aperture is located rearwardly of the forward portion.

12. The spring contact of claim 11, wherein the aperture is located between the forward portion and the rearward portion of the sacrificial ramp.

13. The spring contact of claim 12, wherein the upper end of the failsafe leg protrudes through the aperture only after a mating terminal engages the rearward portion of the sacrificial ramp.

14. The spring contact of claim 10, wherein the relative angles of the sacrificial ramp forward portion, the sacrificial ramp rearward portion, the spring leg, and the failsafe leg cause the failsafe leg to move downwardly when a mating terminal engages the forward portion of the sacrificial ramp, and to move upwardly when the mating terminal engages the rearward portion of the sacrificial ramp.

* * * * *